United States Patent [19]

Bienaimé

[11] Patent Number: 5,058,735

[45] Date of Patent: Oct. 22, 1991

[54] CARRY PACK FOR BOTTLES

[75] Inventor: Patrick Bienaimé, Troissereux, France

[73] Assignee: Unilever Patent Holdings B.V., Netherlands

[21] Appl. No.: 643,700

[22] Filed: Jan. 22, 1991

Related U.S. Application Data

[63] Continuation of Ser. No. 366,189, Jun. 15, 1989, abandoned.

[30] Foreign Application Priority Data

Jun. 15, 1988 [DE] Fed. Rep. of Germany ..... 3820370

[51] Int. Cl.[5] ..... B65D 85/62

[52] U.S. Cl. ..... 206/145; 206/147; 206/148; 206/161; 206/429

[58] Field of Search ..... 206/139, 145, 147, 148, 206/149, 151, 152, 153, 158, 161, 194, 199, 429; 229/40

[56] References Cited

U.S. PATENT DOCUMENTS

| | | | |
|---|---|---|---|
| 2,798,603 | 7/1957 | Grinspoon | 206/429 |
| 3,587,847 | 6/1971 | Graser | 206/153 |
| 3,640,448 | 2/1972 | Wood | 206/158 |
| 4,190,149 | 2/1980 | Oliff et al. | 206/145 |
| 4,304,329 | 12/1981 | Graser | 206/148 |
| 4,378,878 | 4/1983 | Graser | 206/147 |
| 4,453,630 | 6/1984 | Helms et al. | 206/147 |
| 4,465,180 | 8/1984 | Klygis | 206/151 |
| 4,804,089 | 2/1989 | Wilson | 206/147 |

FOREIGN PATENT DOCUMENTS

| | | | |
|---|---|---|---|
| 3023956 | 1/1982 | Fed. Rep. of Germany | 206/145 |

*Primary Examiner*—David T. Fidei

*Attorney, Agent, or Firm*—Cushman, Darby & Cushman

[57] ABSTRACT

Carry pack for bottles made from a single-piece board blank which has a top panel, two side panels and two end panels. The side panels are divided up into three sections by oblique folding lines and their free ends are glued to the end panels. As a result, the bottle carry pack can be flattened again after it has been glued together.

2 Claims, 2 Drawing Sheets

CARRY PACK FOR BOTTLES

This is a continuation of application Ser. No. 07/366,189, filed on June 15, 1989, now abandoned.

BACKGROUND OF THE INVENTION

1. Field of the Invention

The invention relates to a carry pack for at least two bottles made from a single-piece board blank which is provided with holes that the tops of the bottles engage, projections on the bottles bracing themselves against the sections surrounding the holes, which are provided in a horizontal top panel.

2. Description of the Prior Art

DE-OS 36 27 564 already discloses a carry pack of this kind for bottles which holds the bottles extremely securely, but is only relatively simple to produce with an acceptable amount of material in versions for up to four bottles.

The purpose of the invention is to design a carry pack for bottles in such a way that it holds the bottles in a similarly secure way, but is simple and economic to produce for any number of bottles.

SUMMARY OF THE INVENTION

In the solution to this problem proposed by the invention, a side panel, which is divided up into three sections by two oblique folding lines, is hinged to each of the two opposite long sides of the top panel, and two end panels, which are joined to the ends of the two side panels when the bottle carry pack has been erected, are hinged to the two other sides of the top panel.

Hinging the side and end panels to all four sides of the top panel stiffens the latter very effectively. The oblique folding lines have the additional advantage that the carry pack can be flattened again after the side and end panels have been joined by gluing.

It is also very advantageous if in accordance with the invention cuts extend radially from the holes in the top panel and divide the edge areas into several sections.

These edge sections fit very tightly against the bottle neck/top and thus hold the bottle extremely securely.

It can also be provided in accordance with the invention that some of the edge sections are provided on the side panels and interrupt the line hinging the side panels to the top panel.

This means that part of the weight of the bottles is channelled directly into the side panels, which relieves the strain on the top panel very substantially.

BRIEF DESCRIPTION OF THE DRAWINGS

One embodiment of the invention is shown in the drawing.

DETAILED DESCRIPTION OF THE INVENTION

Figure 1:
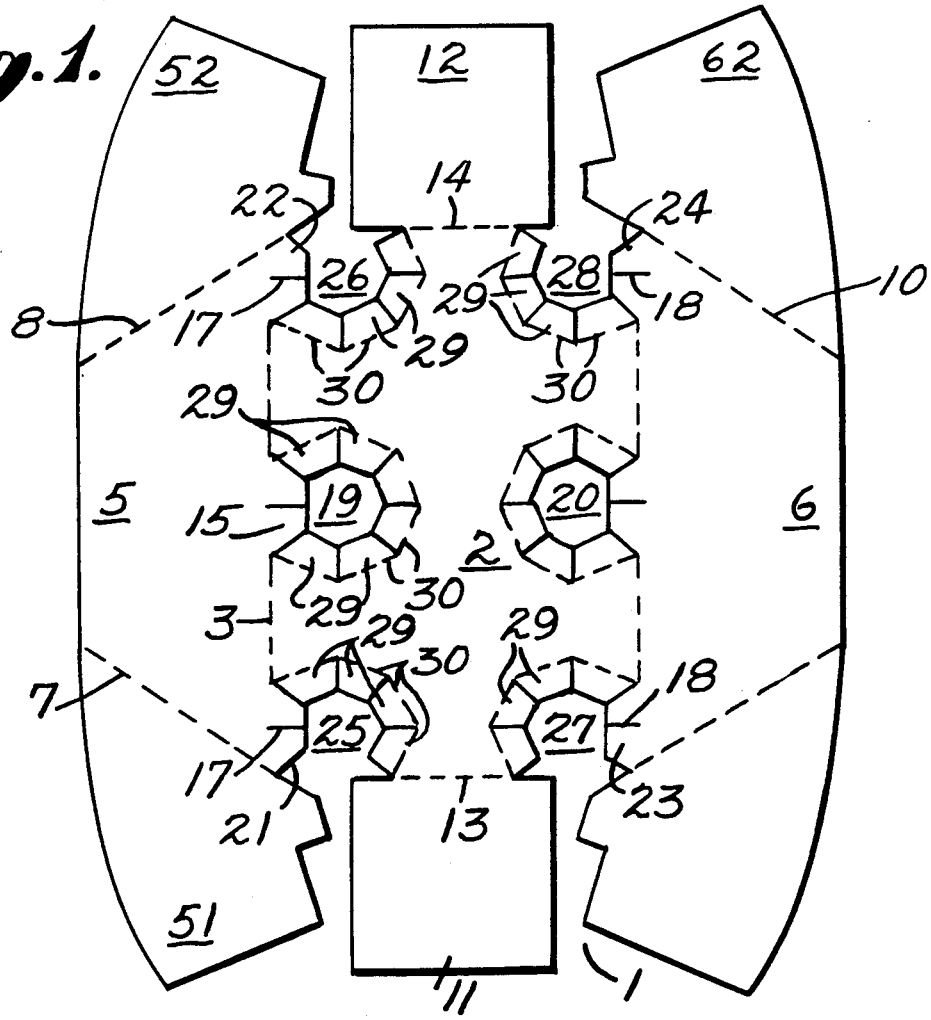
FIG. 1 shows a flat board blank with folding lines provided in the side panels.

1 in FIG. 1 is a board blank which has a top panel 2, to each of the two long sides of which a side panel 5,6 is hinged by a folding line 3,4. Each of the two side panels 5,6 is divided up into three sections 5,51,52 and 6,61,62 by two oblique folding lines 7,8 and 9,10. The two outer sections 51,61 and 52,62 are each joined to an end panel 11,12, that is hinged to the top panel 2 by a folding line 13,14, when the board blank is erected. The folding lines 3 and 4 each consist of two sections located behind each other which are separated by a flap 15,16 provided on the side panel 5,6. These flaps 15 and 16 are each divided up into two sections by a cut 17,18 and project into a hole 19,20 that is provided in the top panel 2. Further flaps 21,22 and 23,24, which are provided in the two side panels 5,6 and project into further holes 25,26 and 27,28, are located at both ends of the two folding lines 3,4. The holes 19,20,25,26,27,28 are limited by flaps 29 on the top panel that are joined to the top panel by a folding line 30.

Figure 2:
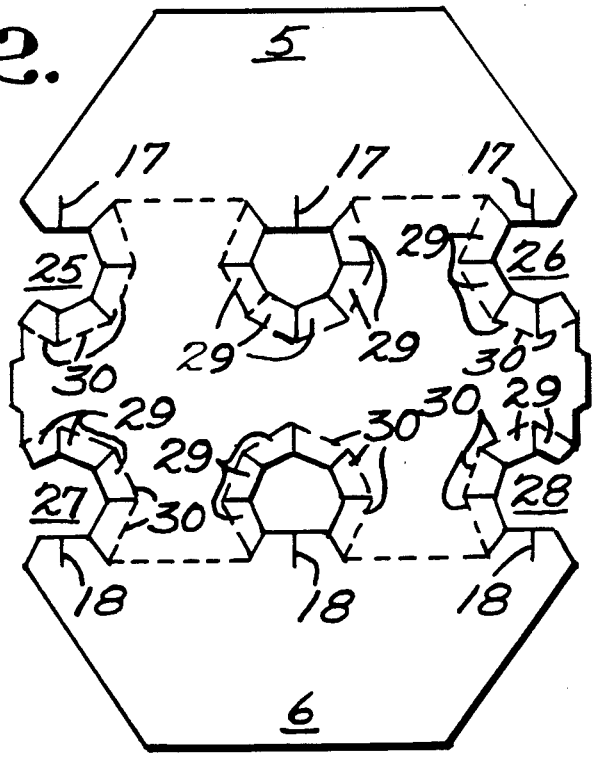
FIG. 2 shows the board blank illustrated in FIG. 1, folded together and glued along the folding lines

When the two end panels 11,12 have been glued to the sections 51,61 and 52,62 of the two side panels, the end panels can be folded downwards and inwards together with these sections—as shown in FIG. 2—so that although production of the carry pack has been completed, the pack is flat again.

Figure 3:
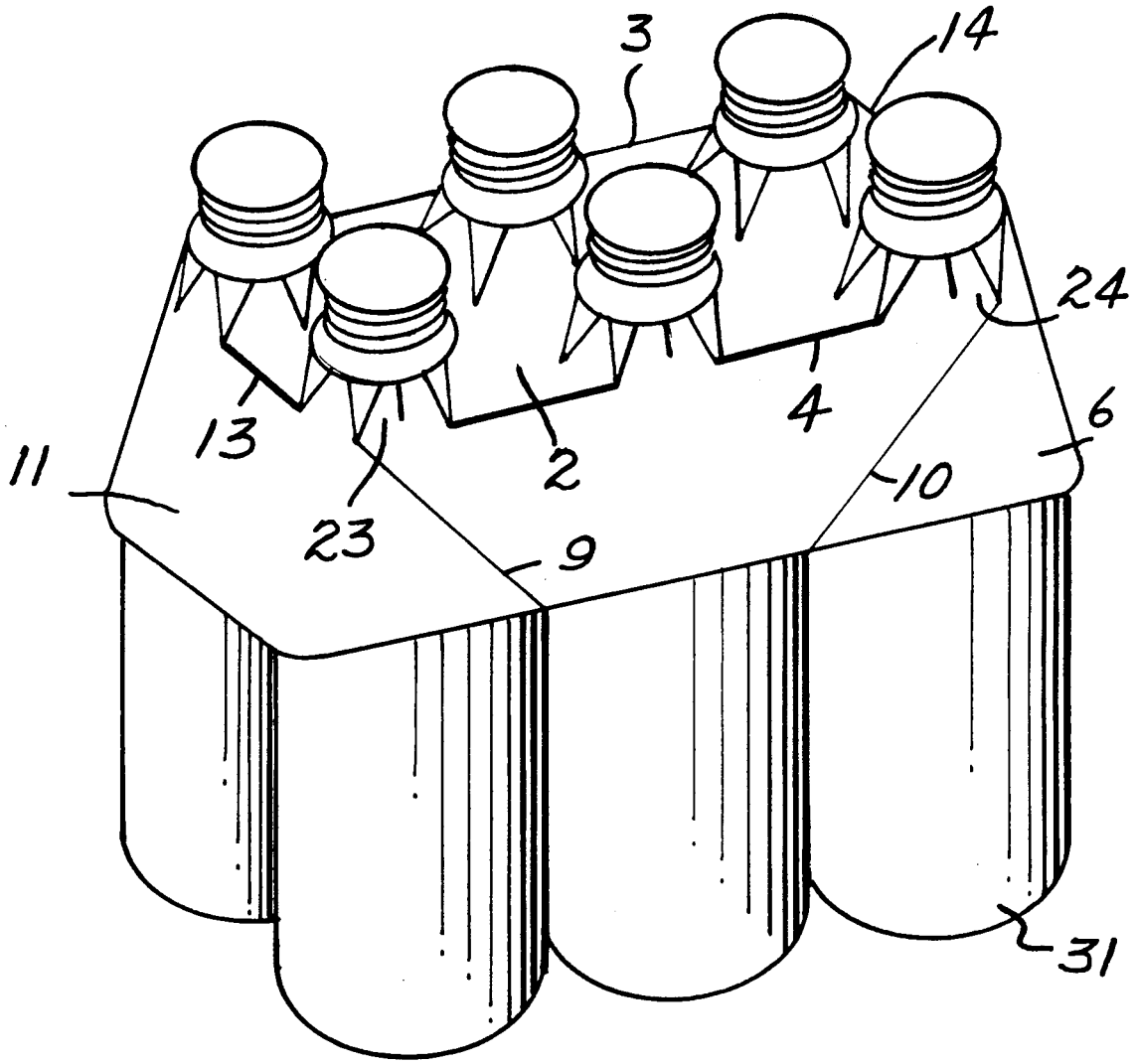
FIG. 3 shows a carry pack erected from the board blank and filled with bottles.

An erected carry pack for bottles is shown in FIG. 3 filled with six bottles 31. The tops of these bottles project through the holes in the top panel 2 and are secured by the flaps.

I claim:

1. Cowl-shaped carry pack for at least two bottles comprising a single-piece board blank including a top panel provided with holes for the tops of bottles to be engaged with projections on the bottles bracing themselves against the holes, said top panel having two opposite long sides, wherein a pair of side panels is provided each of which is divided into three sections by folding lines which extend obliquely from one of the holes and towards each other, each said side panel being hinged to one of said opposite long sides of said top panel, said top panel having two opposite short sides extending between said long sides wherein two end panels are hinged to said top panel along fold lines on a said respective short side so that said end panels can be connected to portions of said side panels when the pack is erected.

2. The carry pack as claimed in claim 1, wherein said holes have edge areas and cuts are provided to extend radially from the holes in said edge areas to define several sections of said edge areas, some of said edge sections being provided on said side panels and interrupt a fold line hinging the side panels to said top panel.

* * * * *